US010365573B2

(12) United States Patent
Sakamoto

(10) Patent No.: US 10,365,573 B2
(45) **Date of Patent: *Jul. 30, 2019**

(54) TWO-COMPONENT DEVELOPER

(71) Applicant: KYOCERA Document Solutions Inc., Osaka (JP)

(72) Inventor: Noriaki Sakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/076,932

(22) PCT Filed: Oct. 16, 2017

(86) PCT No.: PCT/JP2017/037316

§ 371 (c)(1),
(2) Date: Aug. 9, 2018

(87) PCT Pub. No.: WO2018/100900

PCT Pub. Date: Jun. 7, 2018

(65) Prior Publication Data

US 2019/0049871 A1 Feb. 14, 2019

(30) Foreign Application Priority Data

Nov. 30, 2016 (JP) ..... 2016-232349

(51) Int. Cl.

| | |
|---|---|
| ***G03G 9/113*** | (2006.01) |
| ***G03G 9/08*** | (2006.01) |
| ***G03G 9/087*** | (2006.01) |

(52) U.S. Cl.

CPC ..... *G03G 9/1134* (2013.01); *G03G 9/08* (2013.01); *G03G 9/08728* (2013.01); *G03G 9/113* (2013.01); *G03G 9/1139* (2013.01)

(58) Field of Classification Search

CPC ..... G03G 9/1134; G03G 9/08; G03G 9/113; G03G 9/08728; G03G 9/1139

See application file for complete search history.

(56) References Cited

U.S. PATENT DOCUMENTS

| | | | | |
|---|---|---|---|---|
| 7,585,605 | B2 | 9/2009 | Nakamura | |
| 2007/0048651 | A1 | 3/2007 | Nakamura | |
| 2018/0088480 | A1 * | 3/2018 | Kobayashi | G03G 9/09741 |

FOREIGN PATENT DOCUMENTS

| | | | |
|---|---|---|---|
| JP | H06-266152 | A | 9/1994 |
| JP | H10-198078 | A | 7/1998 |

(Continued)

*Primary Examiner* — Thorl Chea

(74) *Attorney, Agent, or Firm* — Studebaker & Brackett PC

(57) ABSTRACT

A two-component developer includes toner particles and carrier particles. The toner particles each include a toner mother particle and first resin particles. The carrier particles each include a carrier mother particle and second resin particles. An amount of the second resin particles is at least 0.010 parts by mass and no greater than 0.100 parts by mass relative to 100 parts by mass of the carrier mother particles. The first resin particles and the second resin particles have a number average primary particle diameter of at least 40 nm and no greater than 100 nm and a blocking rate (measurement temperature: 160° C.) of less than 30% by mass. A difference in blocking rate between the first resin particles and the second resin particles is no greater than 5% by mass, and a difference in number average primary particle diameter therebetween is no greater than 5 nm.

6 Claims, 2 Drawing Sheets

(56) References Cited

FOREIGN PATENT DOCUMENTS

| | | | |
|---|---|---|---|
| JP | 2005-091878 | A | 4/2005 |
| JP | 2007-057659 | A | 3/2007 |
| JP | 2012-203045 | A | 10/2012 |

* cited by examiner

TWO-COMPONENT DEVELOPER

TECHNICAL FIELD

The present invention relates to a two-component developer including a toner and a carrier.

BACKGROUND ART

Patent Literature 1 discloses a technique by which resin fine particles and conductive fine particles are dispersed in resin coat layers of carrier particles in a two-component developer.

CITATION LIST

Patent Literature

[Patent Literature 1]
Japanese Patent Application Laid-Open Publication No. H10-198078

SUMMARY OF INVENTION

Technical Problem

However, it is difficult only by the technique disclosed in Patent Literature 1 to provide a two-component developer use of which can achieve continuous high-quality image formation while inhibiting fogging in continuous printing. Specifically, when the two-component developer disclosed in Patent Literature 1 is stirred in a development device, an external additive of toner particles tends to be detached from the toner particles and attached to carrier particles. Once the external additive of the toner particles is attached to the carrier particles in the development device, a toner particle charging ability of a carrier varies with a result that a toner may be excessively or insufficiently charged.

The present invention has been made in view of the foregoing, and has its object of providing a two-component developer use of which can achieve continuous high-quality image formation while inhibiting fogging in continuous printing.

Solution to Problem

A two-component developer according to the present invention includes a toner and a carrier. The toner includes a plurality of toner particles each including a toner mother particle and a plurality of first resin particles attached to a surface of the toner mother particle. The carrier includes a plurality of carrier particles each including a carrier mother particle and a plurality of second resin particles attached to a surface of the carrier mother particle. An amount of the second resin particles is at least 0.010 parts by mass and no greater than 0.100 parts by mass relative to 100 parts by mass of the carrier mother particles. A blocking rate measured for the first resin particles and a blocking rate measured for the second resin particles are each less than 30% by mass. Each of the blocking rates is measured using a mesh having a sieve opening of 75 μm after 5-minute pressure application under conditions of a temperature of 160° C. and a pressure of 0.1 kgf/mm$^2$. A difference in blocking rate between the first resin particles and the second resin particles is no greater than 5% by mass in terms of an absolute value. Respective number average primary particle diameters of the first resin particles and the second resin particles are at least 40 nm and no greater than 100 nm. A difference in number average primary particle diameter between the first resin particles and the second resin particles is no greater than 5 nm in terms of an absolute value. The first resin particles and the second resin particles contain resins of the same species as each other.

Advantageous Effects of Invention

According to the present invention, a two-component developer can be provided use of which can achieve continuous high-quality image formation while inhibiting fogging in continuous printing.

DESCRIPTION OF EMBODIMENTS

Figure 1:
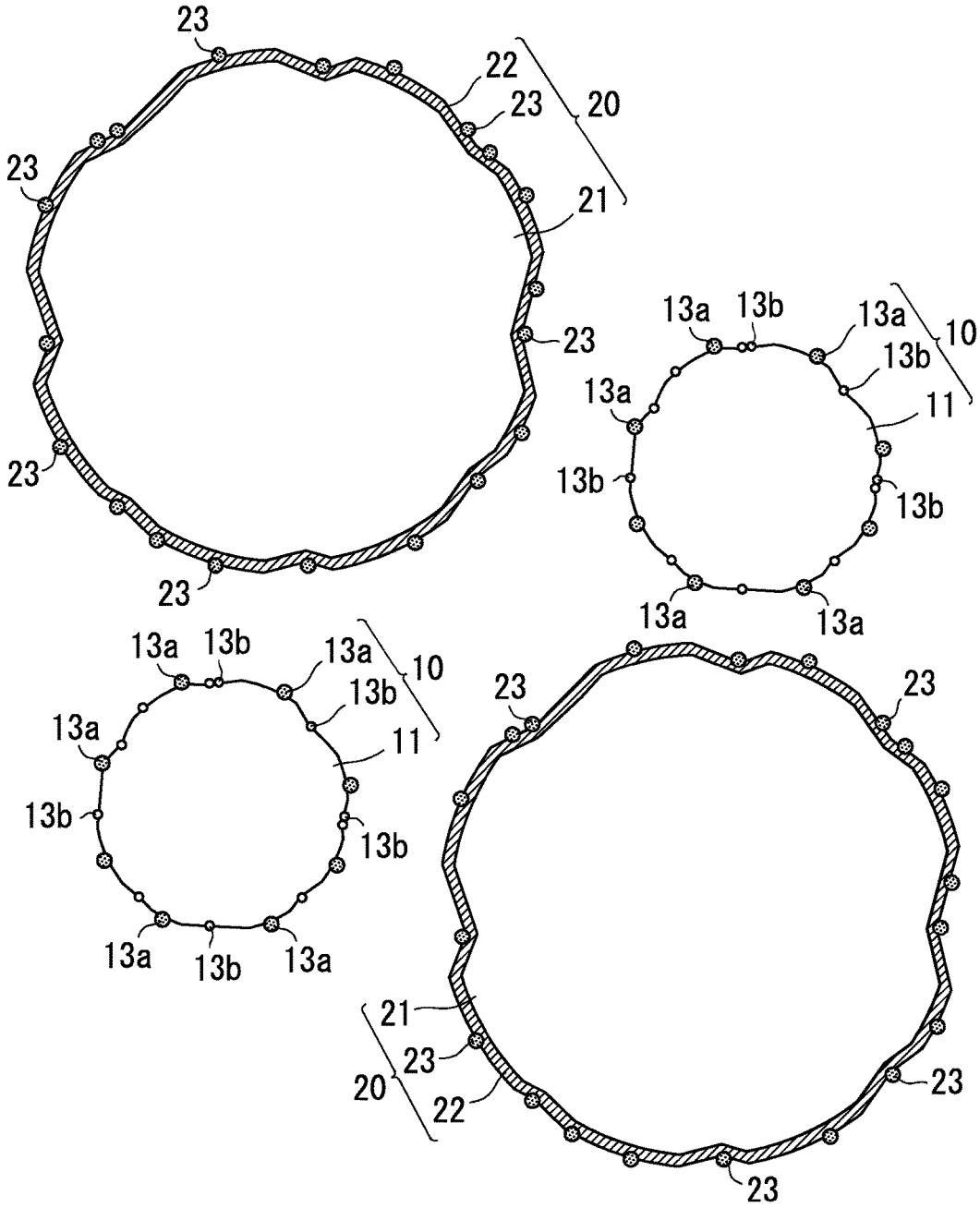
FIG. 1 is a diagram illustrating a configuration of a two-component developer according to an embodiment of the present invention.

An embodiment of the present invention will be described below. Note that evaluation results (for example, values indicating shape and physical properties) for a powder (specific examples include toner mother particles, carrier mother particles, external additive, toner, and carrier) are each a number average of values measured for a suitable number of particles that are selected as average particles of the powder, unless otherwise stated.

The number average particle diameter of a powder is a number average value of equivalent circle diameters of primary particles (Heywood diameters: diameters of circles having the same areas as projected areas of the particles) measured using a microscope, unless otherwise stated. A measured value of a volume median diameter ($D_{50}$) of a powder is a value measured using a laser diffraction/scattering particle size distribution analyzer ("LA-750" produced by Horiba, Ltd.), unless otherwise stated.

Chargeability refers to chargeability by triboelectric charging, unless otherwise stated. A level of positive chargeability (or negative chargeability) in the triboelectric charging can be determined using for example a known triboelectric series.

In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term (meth)acrylic is used as a generic term for both acrylic and methacrylic. The term "(meth)acrylonitrile" is used as a generic term for both acrylonitrile and methacrylonitrile.

A two-component developer according to the present embodiment includes a toner and a carrier. The toner and the carrier each are a powder constituted by a large number of particles. The toner includes a plurality of toner particles having features described below. The carrier includes a plurality of carrier particles having features described below. The toner included in the two-component developer according to the present embodiment can be used for example as a positively chargeable toner. The positively chargeable toner is charged positively by friction with the carrier.

The two-component developer according to the present embodiment can for example be used in image formation using an electrophotographic apparatus (image forming apparatus). The following describes an example of image forming methods that are performed by electrophotographic apparatuses.

First, an image forming section (a charger and a light exposure device) of an electrophotographic apparatus forms an electrostatic latent image on a photosensitive member (for example, on a surface of a photosensitive drum) based on image data. Subsequently, a development device (specifically, a development device loaded with two-component developer) of the electrophotographic apparatus supplies only toner in the two-component developer to the photosensitive member to develop the electrostatic latent image formed on the photosensitive member. The toner is charged by friction with a carrier in the development device before being supplied to the photosensitive member. For example, a positively chargeable toner is charged positively. In the developing step, toner (specifically, charged toner) on a development sleeve (for example, a surface of a development roller in the development device) disposed in the vicinity of the photosensitive member is supplied to the photosensitive member and attached to the electrostatic latent image, which is an irradiated portion of the photosensitive member, so that a toner image is formed on the photosensitive member. Toner in an amount corresponding to the amount of the toner consumed in the developing step is supplied to the development device from a toner container containing toner for replenishment use.

Subsequently, in a transfer step, a transfer device of the electrophotographic apparatus transfers the toner image on the photosensitive member onto an intermediate transfer member (for example, a transfer belt), and then further transfers the toner image on the intermediate transfer member onto a recording medium (for example, paper). Thereafter, a fixing device (fixing method: nip fixing with a heating roller and a pressure roller) of the electrophotographic apparatus fixes the toner to the recording medium by applying heat and pressure to the toner. As a result, an image is formed on the recording medium. A full-color image can for example be formed by superimposing toner images of four different colors: black, yellow, magenta, and cyan. Toner remaining on the photosensitive member after the transfer step is removed by a cleaning member (for example, a cleaning blade). A direct transfer process may alternatively be employed, which involves direct transfer of the toner image on the photosensitive member to the recording medium without use of the intermediate transfer member. The fixing method may be a belt fixing method.

The two-component developer according to the present embodiment has the following features (also referred to below as "basic features").

(Basic Features of Two-Component Developer)

The two-component developer includes a toner and a carrier. The toner includes a plurality of toner particles each including a toner mother particle and a plurality of resin particles (also referred to below as "first resin particles") attached to a surface of the toner mother particle. The carrier includes a plurality of carrier particles each including a carrier mother particle and a plurality of resin particles (also referred to below as "second resin particles") attached to a surface of the carrier mother particle. The amount of the second resin particles is at least 0.010 parts by mass and no greater than 0.100 parts by mass relative to 100 parts by mass of the carrier mother particles. A blocking rate for the first resin particles and a blocking rate for the second resin particles each measured using a mesh with a sieve opening of 75 μm after 5-minute pressure application under conditions of a temperature of 160° C. and a pressure of 0.1 $kgf/mm^2$ are each less than 30% by mass. A difference in blocking rate between the first resin particles and the second resin particles is no greater than 5% by mass in terms of an absolute value. Respective number average primary particle diameters of the first resin particles and the second resin particles are at least 40 nm and no greater than 100 nm. A difference in number average primary particle diameter between the first resin particles and the second resin particles is no greater than 5 nm in terms of an absolute value. The first resin particles and the second resin particles contain resins of the same species as each other.

A condition in which two or more resins are of the same species as each other means a condition in which the species of monomers constituting these resins are substantially the same therebetween and presence or absence of cross-linkage is the same therebetween. In determination as to whether or not two or more resins are of the same species as each other, composition ratio of monomers of the resins, type of a cross-linking agent, and degree of cross-linkage are not taken into consideration. For example, a resin that has a composition ratio of monomers of 50/50 ("styrene/butyl acrylate", mass ratio) and that is cross-linked by divinylbenzene and a resin that has a composition ratio of monomers of 30/70 ("styrene/butyl acrylate, mass ratio) and that is cross-linked by ethylene glycol dimethacrylate have the same species of monomers constituting the respective resins as each other and are both cross-linked. Therefore, they are resins of the same species as each other.

In the above basic features, a blocking rate measuring method is the same method as that described in later-described Examples or an alternative method thereof. In the following description, a blocking rate of resin particles defined in the basic features may be referred simply to a "blocking rate of the resin particles" with the measurement conditions and the like omitted.

A blocking rate of resin particles in the basic features indicates ease of being thermally compressed. As the blocking rate of resin particles is increased, the resin particles tend to be thermally compressed more readily. As the blocking rate of resin particle is decreased, the resin particles become harder. Also, heat resistance of the resin particles increases and the resin particles tend to more hardly agglomerate. In order to set the blocking rate of resin particles less than 30% by mass, production of very hard resin particles is thought to be required. The present inventor succeeded in attaining a blocking rate of resin particles of less than 30% by mass through use of a high-purity cross-linking agent. In a case for example where divinylbenzene is used as a cross-linking agent, divinylbenzene having a purity (mass fraction) of about 50% is typically used. By contrast, the present inventor succeeded in attaining a blocking rate of resin particles of less than 30% by mass through use of divinylbenzene having a purity (mass fraction) of 80%. The blocking rate of resin particles can be adjusted for example changing an amount of the cross-linking agent in resin synthesis. As the amount of the cross-linking agent is increased, the number of cross-linking points increases and the resin particles becomes harder, with a result that the blocking rate of the resin particles tends to decrease.

Toner remaining on a photosensitive drum of a typical image forming apparatus is removed together with other extraneous matter on the photosensitive drum by cleaning after the transfer step. For example, a surface of the photosensitive drum is rubbed by an edge of a cleaning blade to scrape and remove extraneous matter on the photosensitive drum in a blade cleaning method.

In order for resin particles (external additive) attached to surfaces of mother particles (toner mother particles or carrier mother particles) to function as spacers between the mother particles, the resin particles preferably have a number average primary particle diameter of at least 40 nm and no greater than 100 nm. However, the present inventor found that the following problems are involved when resin particles are used as an external additive. The present inventor tackled the problems to invent a two-component developer having the above basic features.

(First Problem)

The present inventor directed his attention to a fact that resin particles included as an external additive of toner particles are detached from the toner particles and then attached to a surface of the photosensitive drum in continuous printing using the toner particles. When the surface of the photosensitive drum is cleaned by a blade cleaning method using a cleaning blade, resin particles present on the surface of the photosensitive drum are sandwiched between the photosensitive drum and the cleaning blade and receive heat and pressure by friction. It is difficult to form a high-quality image once the resin particles adhere to the surface of the photosensitive drum by thermal compression (specifically, plastic deformation) through application of heat and pressure. Specifically, a dash mark (image defect due to adhesion matter present on the surface of the photosensitive drum) tends to be formed on a formed image.

In a configuration in which the blocking rate of the first resin particles (external additive of the toner particles) is excessively high, contamination of the photosensitive member (adhesion of resin particles to the surface of the photosensitive drum) tends to be readily caused upon application of heat and pressure to the resin particles in blade cleaning.

(Second Problem)

A two-component developer (toner and carrier) used in a typical image forming apparatus is used while being stirred in a development device. When an external additive of toner particles is detached from the toner particles by stirring, the detached external additive may be attached to carrier particles. When the external additive of the toner particles is attached to or detached from the carrier particles in the development device, a toner particle charging ability of the carrier varies with a result that a toner may be excessively or insufficiently charged.

The blocking rate of the first resin particles (external additive of the toner particles) and the blocking rate of the second resin particles (external additive of the carrier particles) in the two-component developer having the above basic features are each less than 30% by mass. In the above configuration, the first resin particles and the second resin particles hardly adhere to the surface of the photosensitive drum with a result that contamination of the photosensitive member can be inhibited. Furthermore, when the blocking rate of resin particles is excessively large, the resin particles tend to deform. When either or both the first resin particles and the second resin particles deform, fluidity of either or both the toner and the carrier (eventually, mixing of the toner and the carrier in the development device) becomes worse to make it difficult to quickly charge the toner to a sufficient charge level.

The amount of the second resin particles attached to the surface of each carrier mother particle is at least 0.010 parts by mass and no greater than 0.100 parts by mass relative to 100 parts by mass of the carrier mother particles in the two-component developer having the above basic features. Attachment of an appropriate amount of second resin particles to the surface of each carrier mother particle can inhibit contamination of the carrier particles by the external additives. Specifically, the second resin particles (external additive) present on the surface of the carrier mother particle protrude from the surface of the carrier mother particle. Due to the presence of the protruding second resin particles, the first resin particles detached from the toner particles are hardly attached to the surface of the carrier mother particle. Accordingly, the first resin particles (external additive of the toner particles) hardly move from the toner particles to the carrier particles in the development device. When the amount of the second resin particles attached to the surface of the carrier mother particle is excessively small, contamination of the carrier particles cannot be sufficiently inhibited. When the amount of the second resin particles attached to the surface of the carrier mother particle is excessively large, a toner particle charging ability of the carrier tends to vary due to detachment of the second resin particles.

In order to inhibit variation in toner particle charging ability of the carrier in a situation in which the external additive moves from the toner particles to the carrier particles, the first resin particles (toner external additive: external additive of the toner particles) and the second resin particles (carrier external additive: external additive of the carrier particles) preferably have the same property as (or approximate property to) each other. In the two-component developer having the above basic features, the second resin particles (external additive of the carrier particles) having almost the same property as that of the first resin particles (external additive of the toner particles) are present on the surfaces of the carrier mother particles. Specifically, a difference in blocking rate between the first resin particles and the second resin particles is no greater than 5% by mass in terms of an absolute value. A difference in number average primary particle diameter between the first resin particles and the second resin particles is no greater than 5 nm in terms of an absolute value. The first resin particles and the second resin particles contain resins of the same species as each other. In the above configuration, variation in chargeability of the toner and variation in toner particle charging ability of the carrier are thought to be small even when the external additives move from the toner particles to the carrier particles or the external additive moves from the carrier particles to the toner particles. Therefore, charge failure of the toner hardly occurs in the two-component developer having the above basic features. Use of the two-component developer having the features as described above can achieve continuous inhibition of fogging in continuous printing.

As described above, by using the two-component developer having the above basic features, fogging and adhesion of foreign matter to the photosensitive member can be inhibited and continuous formation of high-quality images (specifically, images with no dash mark) can be achieved.

In order to obtain a two-component developer suitable for image formation, both the first resin particles and the second resin particles preferably contain a cross-linked styrene-acrylic acid-based resin. The cross-linked styrene-acrylic acid-based resin is excellent in chargeability, and fine particles having uniform shape and dimension can be more easily produced with use of the cross-linked styrene-acrylic acid-based resin when compared to with use of a melamine resin or the like. The cross-linked styrene acrylic acid-based resin has favorable durability and charge stability. As to charge stability, decrease in amount of charge particularly in a high-temperature and high-humidity environment can be inhibited.

The cross-linked styrene-acrylic acid-based resin is a polymer of monomers (resin raw materials) including at least one styrene-based monomer, at least one acrylic acid-based monomer, and a cross-linking agent. Styrene-based monomers, acrylic acid-based monomers, and cross-linking agents listed below can for example be favorably used for synthesis of the cross-linked styrene-acrylic acid-based resin.

Examples of preferable styrene-based monomers include styrene, alkyl styrenes (specific examples include α-methylstyrene, p-ethylstyrene, and 4-tert-butylstyrene), hydroxystyrenes (specific examples include p-hydroxystyrene and m-hydroxystyrene), and halogenated styrenes (specific examples include α-chlorostyrene, o-chlorostyrene, m-chlorostyrene, and p-chlorostyrene).

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include acid 2-hydroxyethyl (meth) acrylate, 3-hydroxypropyl (meth)acrylate, 2-hydroxypropyl (meth)acrylate, and 4-hydroxybutyl (meth)acrylate.

The cross-linking agent is preferably a compound having at least two unsaturated bonds. A particularly preferable cross-linking agent is a monocyclic compound having at least two functional groups each having an unsaturated bond (specific examples include divinylbenzene) or a condensate of one polyhydric alcohol and at least two monobasic carboxylic acids each having a functional group having an unsaturated bond (specific examples include ethylene glycol dimethacrylate). Examples of functional groups having an unsaturated bond include a vinyl group ($CH_2{=}CH{-}$) and a substituted vinyl group in which hydrogen is replaced.

In order that the two-component developer has the above basic features, both of the first resin particles and the second resin particles particularly preferably contain a polymer (specific cross-linked styrene-acrylic acid-based resin) of monomers (resin raw materials) including (meth)acrylic acid alkyl ester having at an ester moiety thereof an alkyl group having a carbon number of at least 1 and no greater than 4, a styrene-based monomer, and a cross-linking agent having at least two unsaturated bonds.

In order to appropriately attach the second resin particles to the surface of each carrier mother particle, the carrier mother particle preferably includes a carrier core and a coat layer covering a surface of the carrier core, and it is particularly preferable that the coat layer contains a fluororesin. The fluororesin is soft. It is therefore thought that as a result of the coat layer containing the fluororesin, the second resin particles tend to be embedded in the surface of the carrier mother particle. The fluororesin has strong negative chargeability. As a result of the coat layer containing the fluororesin, a positively chargeable toner can be readily charged positively. However, when the amount of the second resin particles attached to a surface of the coat layer is excessively large, the surface of the coat layer covered with the second resin particles is out of contact with the toner particles with a result of no contribution of the coat layer to triboelectric charging of the toner. In order to cause the coat layer to contribute to triboelectric charging of the toner, a region of the surface of the coat layer to which the second resin particles are not attached is preferably present at a sufficiently large area ratio. When the amount of the second resin particles attached to the surface of each carrier mother particle is at least 0.010 parts by mass and no greater than 0.100 parts by mass relative to 100 parts by mass of the carrier mother particles, a region of the surface of the coat layer to which the second resin particles are not attached tends to have an appropriate area ratio.

In order to obtain a two-component developer suitable for image formation, it is preferable that at least one type of inorganic particles are attached to a surface of each toner mother particle in addition to the first resin particles and no inorganic particles are attached to the surface of the carrier mother particle. As a result of the inorganic particles being attached to the surface of the toner mother particle, sufficient fluidity of the toner can tend to be ensured. As a result of titanium oxide particles being attached to the surface of the toner mother particle, polishing characteristics can be imparted to the toner particles. As a result of no inorganic particles being attached to the surface of the carrier mother particle, variation in toner particle charging ability of the carrier can be inhibited. Note that a state in which the inorganic particles (external additive of the toner particles) detached from the toner particles in mixing the toner with the carrier in production of the two-component developer are attached to the surface of the carrier mother particle is not encompassed by a state in which "the inorganic particles are externally added to the surface of the carrier mother particle". It is thought that the inorganic particles detached from the toner particles in the two-component developer are not unified with (bonded to) the carrier mother particle, but are present on the surface of the carrier mother particle in a state of being readily detachable from the carrier mother particle. "The inorganic particles being externally added to the surface of the carrier mother particle" means that the inorganic particles are unified with (bonded to) the carrier mother particle and held stably on the surface of the carrier mother particle at least in a stationary state (a state in which no stress is applied).

In order to cause the external additives to sufficiently exhibit their function while inhibiting detachment of external additive particles from the toner particles, it is preferable that the amount of the first resin particles is at least 0.5 parts by mass and no greater than 1.5 parts by mass relative to 100 parts by mass of the toner mother particles and a total amount of the at least one type of inorganic particles is at least 1.0 part by mass and no greater than 4.5 parts by mass relative to 100 parts by mass of the toner mother particles.

Different from internal additives, the external additives are not present within respective corresponding mother particles and are selectively present only on a surface of each of the mother particles. The external additive particles can be attached to the surface of each mother particle, for example, by stirring the mother particles (powder) and the external additive (powder) together in an external additive addition process. The external additive particles are unified with the mother particle by stirring to be stably held on the surface of the mother particle. The mother particle and the external additive particles are bonded together physically rather than chemically without chemical reaction therebetween. Bonding strength between the mother particle and the external additive particles can be adjusted for example according to particle diameter, shape, hardness, surface condition, and the like of the external additive particles and mixing conditions (specific examples include a mixing time period and a rotational speed for stirring). In order to inhibit detachment of the external additive particles, it is preferable that the external additive particles are strongly bonded to the surface of the mother particle. The external additive particles may be secured to the surface of the mother particle through embedment by mechanical bonding. In a case of for example external additive particles having a large particle diameter, a part (bottom part) of each external additive particle can be embedded in a surface portion of the mother particle and secured to the surface of the mother particle by vigorously stirring the mother particles and the external additive together. However, when the particle diameter of the external additive particles is excessively large, it is difficult to secure the external additive particles to the surface of the mother particle. In order to improve fluidity of the toner or the carrier through use of the corresponding external additive particles, it is preferable that the external additive particles are weakly connected to the surface of the mother particle (for example, spherical external additive particles having a small particle diameter are attached to the surface of the mother particle in a rotatable manner). The external additive particles (for example, silica particles) for improving fluidity of the toner or the carrier are preferably attached to the surface of the mother particle mainly by Van der Waals force or static electric force.

The following describes an example of the two-component developer having the above basic features with reference to FIG. 1.

The two-component developer illustrated in FIG. 1 includes a toner (specifically, a powder of toner particles 10) and a carrier (specifically, a powder of carrier particles 20). The toner includes a plurality of the toner particles 10 each including a toner mother particle 11, a plurality of first resin particles 13*a*, and a plurality of inorganic particles 13*b* (for example, silica particles). The plurality of first resin particles 13*a* and the plurality of inorganic particles 13*b* are attached to a surface of the toner mother particle 11. The carrier includes a plurality of the carrier particles 20 each including a carrier mother particle (specifically, a carrier core 21 and a coat layer 22) and a plurality of second resin particles 23. The carrier mother particle includes the carrier core 21 and the coat layer 22 covering a surface of the carrier core 21. The coat layer 22 may cover the surface of the carrier core 21 entirely or partially. However, it is preferable that the coat layer 22 fully covers the entire surface region of the carrier core 21 (that is, at a coverage of 100%) in order to ensure sufficient toner particle charging ability and durability of the carrier. The plurality of second resin particles 23 are attached to the surface of each of the carrier mother particles.

A blocking rate of the first resin particles 13*a* (specifically, a blocking rate thereof measured using a mesh having a sieve opening of 75 μm after 5-minute pressure application at a temperature of 160° C. and a pressure of 0.1 kgf/mm$^2$) is less than 30% by mass. A blocking rate of the second resin particles 23 (specifically, a blocking rate thereof measured using a mesh having a sieve opening of 75 μm after 5-minute pressure application at a temperature of 160° C. and a pressure of 0.1 kgf/mm$^2$) is less than 30% by mass. A difference in blocking rate between the first resin particles 13*a* and the second resin particles 23 is no greater than 5% by mass in terms of an absolute value. A difference in number average primary particle diameter between the first resin particles 13*a* and the second resin particles 23 is no greater than 5 nm in terms of an absolute value. The first resin particles 13*a* and the second resin particles 23 contain resins of the same species as each other (for example, cross-linked styrene-acrylic acid based resins).

The toner particles included in the toner may be toner particles each including a toner mother particle including no shell layer (also referred to below as "non-capsule toner particles") or toner particles each including a toner mother particle including a shell layer (also referred to below as "capsule toner particles). Capsule toner particles can be produced by forming shell layers on surfaces of the toner mother particles (toner cores) of non-capsule toner particles. The shell layers may be substantially formed from only a thermosetting resin or a thermoplastic resin, or contain both a thermoplastic resin and a thermosetting resin.

The non-capsule toner particles can be produced for example by a pulverization method or an aggregation method. When the non-capsule toner particles are produced by either one of the above methods, an internal additive can be favorably and easily dispersed in a binder resin of the non-capsule toner particles. Note that it is known in a technical field to which the present invention belongs that toners are categorized into pulverized toners and polymerized toners (also called chemical toners). A toner produced by a pulverization method belongs to the pulverized toners, and a toner produced by an aggregation method belongs to the polymerized toners.

In an example of pulverization methods, a binder resin, a colorant, a charge control agent, and a releasing agent are mixed together first. Subsequently, the resultant mixture is melt-kneaded using a melt-kneader (for example, a single or twin screw extruder). Next, the resultant melt-kneaded substance is pulverized and the resultant pulverized substance is classified. Through the above, toner mother particles are obtained. Toner mother particles can be produced more easily by the pulverization method than by the aggregation method in many cases.

In an example of aggregation methods, a binder resin, a releasing agent, a charge control agent, and a colorant each in the form of fine particles are caused to aggregate in an aqueous medium containing these fine particles to form particles having a desired particle diameter. Through aggregation, aggregated particles including the binder resin, the releasing agent, the charge control agent, and the colorant are formed. Next, the resultant aggregated particles are heated to coalesce components included in the aggregated particles. Through the above, toner mother particles having a desired particle diameter are obtained.

In production of capsule toner particles, any method may be employed for shell layer formation. The shell layers may be formed for example by an in-situ polymerization process, an in-liquid curing film coating process, or a coacervation process.

The following describes a preferable example of respective configurations of the non-capsule toner particles and the carrier particles. Note that toner mother particles of non-capsule toner particles described below may be used as toner cores for the capsule toner particles.

[Toner Mother Particles]

The toner mother particles contain a binder resin. The toner mother particles may optionally contain an internal additive (for example, a colorant, a releasing agent, a charge control agent, and a magnetic powder).

(Binder Resin)

The binder resin is typically a main component (for example, at least 80% by mass) of the toner mother particles. Accordingly, properties of the binder resin are thought to have a great influence on overall properties of the toner mother particles.

Examples of preferable binder resins include styrene-based resins, acrylic acid-based resins (specific examples include acrylic acid ester polymer and methacrylic acid ester polymer), olefin-based resins (specific examples include polyethylene resin and polypropylene resin), vinyl chloride resins, polyvinyl alcohols, vinyl ether resins, N-vinyl resins, polyester resins, polyamide resins, and urethane resins. A copolymer of any of the resins listed above, that is, a copolymer of any of the resins listed above into which an optional repeating unit is included (specific examples include a styrene-acrylic acid-based resin and a styrene-butadiene-based resin) may also be used.

In order to achieve both heat-resistant preservability and low-temperature fixability of the toner, the toner mother particles preferably contain at least one of a polyester resin and a styrene-acrylic acid-based resin and particularly preferably contain a polyester resin.

The polyester resin is obtained by condensation polymerization of at least one polyhydric alcohol (specific examples include aliphatic diols, bisphenols, and tri- or higher hydric alcohols listed below) and at least one polybasic carboxylic acid (specific examples include dibasic carboxylic acids and tri- or higher basic carboxylic acids listed below). The polyester resin may include a repeating unit derived from another monomer (that is, a monomer other than the polyhydric alcohol and the polybasic carboxylic acid)

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkanedicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

The toner mother particles may optionally contain a colorant. A known pigment or dye matching a color of the toner can be used as a colorant. In order to obtain a toner suitable for image formation, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may contain a non-black colorant such as a yellow colorant, a magenta colorant, or a cyan colorant.

At least one compound for example selected from the group consisting of condensed azo compounds, isoindolinone compounds, anthraquinone compounds, azo metal complexes, methine compounds, and arylamide compounds can be used as a yellow colorant. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound for example selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as a magenta colorant. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound for example selected from the group consisting of copper phthalocyanine compounds, anthraquinone compounds, and basic dye lake compounds can be used as a cyan colorant. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may optionally contain a releasing agent. The releasing agent is used for example for the purpose in improving fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide waxes and block copolymers of polyethylene oxide waxes; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester has been partially or fully deoxidized such as deoxidized carnauba wax. One of the releasing agents listed above may be used independently, or two or more of the releasing agents listed above may be used in combination.

(Charge Control Agent)

The toner mother particles may optionally contain a charge control agent. The charge control agent is for example used in order to improve charge stability or a charge rise characteristic of the toner. The charge rise characteristic of the toner is an indicator as to whether the toner can be charged to a specific charge level in a short period of time.

The cationic strength of the toner mother particles can be increased through the toner mother particles containing a positively chargeable charge control agent (specific examples include pyridine, nigrosine, and quaternary ammonium salt). However, in a situation in which it is ensured that the toner has sufficient chargeability, the toner mother particles do not need to contain a charge control agent.

(Magnetic Powder)

The toner mother particles may optionally contain a magnetic powder. Examples of materials of the magnetic powder that can be preferably used include ferromagnetic metals (specific examples include iron, cobalt, nickel, and alloys of any one or more of the aforementioned metals), ferromagnetic metal oxides (specific examples include ferrite, magnetite, and chromium dioxide), and materials subjected to ferromagnetization (specific examples include carbon materials made ferromagnetic through thermal treatment). In order to inhibit elution of metal ions (for example, iron ions) from the magnetic powder, surface-treated magnetic particles are preferably used as the magnetic powder. One magnetic powder may be used independently, or two or more magnetic powders may be used in combination.

[Toner External Additive]

A toner external additive (specifically, a powder including a plurality of external additive particles) is attached to the surface of each toner mother particle in the two-component developer having the above basic features. The toner particles include a plurality of the first resin particles as the toner external additive. For example, when the toner mother particles (powder) and the external additive (powder) are stirred together, parts (bottom parts) of the external additive particles (for example, the first resin particles) are embedded in a surface portion of the toner mother particle such that the external additive particles are attached to a surface of the toner mother particle by physical force (physical bond).

Resin particles containing at least one resin selected from the group consisting of cross-linked styrene-based resins, cross-linked acrylic acid-based resins, cross-linked styrene-acrylic acid-based resins, cross-linked polyester resins, cross-linked urethane resins, cross-linked polyacrylamide resins, and cross-linked polyacrylonitrile resins are preferable as the first resin particles (toner external additive). Resin particles containing a cross-linked styrene-acrylic acid-based resin are particularly preferable.

In addition to the first resin particles, inorganic particles may be optionally attached to the surface of the toner mother particle. Silica particles or particles of metal oxides (specific examples include alumina, titanium oxide, magnesium oxide, zinc oxide, strontium titanate, and barium titanate) are preferable as the inorganic particles (toner external additive). At least one type of particles selected from the group consisting of silica particles and titanium oxide particles are particularly preferable.

The external additive particles may be surface-treated. For example, in a situation in which silica particles are used as the external additive particles, either or both of hydrophobicity and positive chargeability may be imparted to surfaces of the silica particles through use a surface treatment agent. Examples of surface treatment agents that can be preferably used include coupling agents (specific examples include silane coupling agent, titanate coupling agent, and aluminate coupling agent) and silicone oils (specific examples include dimethylsilicone oil). As a silane coupling agent, a silane compound (specific examples include methyltrimethoxysilane and aminosilane) or a silazane compound (specific examples include hexamethyldisilazane (HMDS)) may be used. When a surface of a silica base (untreated silica particles) is treated with a surface treatment agent, a large number of hydroxyl groups (—OH) present on the surface of the silica base are partially or fully substituted by functional groups derived from the surface treatment agent. As a result, silica particles having on surfaces thereof the functional groups derived from the surface treatment agent (specifically, functional groups that are more hydrophobic and/or more readily positively chargeable than the hydroxyl groups) are obtained. For example, treatment on the surface of the silica base with a silane coupling agent having amino groups causes dehydration condensation reaction ("A (silica base)-OH"+"B (coupling agent)-OH"→"A-O—B"+$H_2O$) of hydroxyl groups of the silane coupling agent (for example, hydroxyl groups generated through hydrolysis of alkoxy groups of the silane coupling agent by moisture) with hydroxyl groups present on the surface of the silica base. As a result of chemical bonding between silica and the silane coupling agent having amino groups through the above reaction, the amino groups are provided to the surfaces of the silica particles. More specifically, the hydroxyl groups present on the surface of the silica base are substituted by functional groups having amino groups at a terminal end thereof (specific examples include —O—Si—$(CH_2)_3$—$NH_2$). The silica particles provided with the amino groups tend to have stronger positive chargeability than the silica base (untreated silica particles). Use of a silane coupling agent having alkyl groups can substitute the hydroxyl groups present on the surface of the silica base by functional groups having alkyl groups at a terminal end thereof (more specifically, —O—Si—$CH_3$ or the like) through the above dehydration condensation reaction. Thus, silica particles to which hydrophobic groups (alkyl groups) are provided in place of hydrophilic groups (hydroxyl groups) tend to be more strongly hydrophobic than the silica base (untreated silica particles).

[Carrier Mother Particles]

The carrier mother particles may be carrier mother particles having no coat layer (for example, ferrite carrier particles) or carrier mother particles each having a coat layer (also referred to below as "coated carrier particles"). In order to achieve high-quality image formation using the two-component developer for an extended period of time, the coated carrier particles are preferably used. The coated carrier particles each include a carrier core and a coat layer covering a surface of the carrier core. In order to ensure sufficient toner particle charging ability and durability of the carrier, the coat layer preferably covers at least 90% of a surface region of the carrier core and particularly preferably covers 100% thereof.

The following describes a preferable example of the coated carrier particles. Note that carrier cores having the following features may be directly used as carrier mother particles without being coated with the coat layers.

(Carrier Core)

The carrier cores preferably contain a magnetic material. The carrier cores may be particles made from a magnetic material or particles constituted by a binder resin in which particles of a magnetic material are dispersed. Examples of preferable magnetic materials contained in the carrier cores include iron oxides such as magnetite, barium ferrite, maghemite, Mn—Zn ferrite, Ni—Zn ferrite, Mn—Mg ferrite, Ca—Mg ferrite, Li ferrite, and Cu—Zn ferrite. One of the magnetic materials listed above may be used independently or two or more of the magnetic materials listed above may be used in combination as a material of the carrier cores. Commercially available carrier cores may be used as the carrier cores. Alternatively, self-made carrier cores may be produced by pulverizing and baking a magnetic material. In production of the carrier cores, saturation magnetization of the carrier can be adjusted by changing the amount of the magnetic material (particularly, a rate of a ferromagnetic material). Also, roundness of the carrier can be adjusted by changing baking temperature in production of the carrier cores.

(Coat Layer)

The coat layer is disposed on the surface of the carrier core to cover the carrier core. The coat layer is substantially constituted by a resin. An additive may be dispersed in the resin constituting the coat layer. Examples of coat layer forming methods include a method in which carrier cores are dipped in a liquid containing a resin (or a material of the resin) and a method in which a liquid containing a resin (or a material of the resin) is sprayed toward carrier cores in a fluidized bed.

At least one resin selected from the group consisting of fluororesins, silicone resins, fluorine-modified silicone resins, acrylic acid-based resins, urethane resins, melamine resins, polyamide-imide resins, polyamide resins, and polyimide resins is preferable as the resin constituting the coat layer. In order to reduce adhesiveness (ease of adhesion) of the carrier mother particles, the coat layer particularly preferably contains a fluororesin and at least one resin selected from the group consisting of polyamide-imide resins (PAI) and polyimide resins (PI). In order to ensure sufficient negative chargeability of the carrier while inhibiting adhesion of the carrier to the photosensitive member, a ratio of an amount of the fluororesin relative to a total amount of resins constituting the coat layer is preferably at least 50% by mass and no greater than 90% by mass. Use of readily positively chargeable resin particles as a carrier external additive can achieve selective attachment of the carrier external additive to portions of the fluororesin contained in the coat layer. At least one resin selected from the group consisting of polyvinyl fluorides, polyvinylidene fluorides, polytetrafluoroethylenes (PTFEs), polytrifluoroethylenes (specific examples include polychlorotrifluoroethylene), polyhexafluoropropylenes, tetrafluoroethylene-hexafluoropropylene copolymers (FEPs), and tetrafluoroethylene-perfluoroalkylvinylether copolymers (PFAs) is perferable as a fluororesin contained in the coat layer. A FEP or a PFA is particularly preferable.

[Carrier External Additive]

An external additive (specifically, a powder including a plurality of external additive particles) is attached to a surface of each carrier mother particle in the two-component developer having the above basic features. Each of the carrier particles includes a plurality of the second resin particles as the carrier external additive. For example, when the carrier mother particles (powder) and the external additive (powder) are stirred together, parts (bottom parts) of the external additive particles (for example, the second resin particles) are embedded in a surface portion of each carrier mother particle such that the external additive particles are attached to the surface of the carrier mother particle by physical force (physical bond).

Resin particles containing at least one resin selected from the group consisting of cross-linked styrene-based resins, cross-linked acrylic acid-based resins, cross-linked styrene-acrylic acid-based resins, cross-linked polyester resins, cross-linked urethane resins, cross-linked polyacrylamide resins, and cross-linked polyacrylonitrile resins are preferable as the second resin particles (carrier external additive). Resin particles containing a cross-linked styrene-acrylic-acid based resin are particularly preferable.

EXAMPLES

The following describes Examples of the present invention. Table 1 shows developers DA-1 to DA-4 and DB-1 to DB-6 according to Examples and Comparative Examples (two-component developers for electrostatic latent image development use). Table 2 shows external additives (resin particles S-1 to S-7) used in production of corresponding developers listed in Table 1. Toners used in the developers DA-1 to DA-4 and DB-1 to DB-6 each were a positively chargeable toner.

TABLE 1

| | External additive (resin particles) | | | | |
|---|---|---|---|---|---|
| | First resin particles (toner) | | Second resin particles (carrier) | | Carrier |
| Developer | Type | Amount [part by mass] | Type | Amount [part by mass] | mobility [second] |
| DA-1 | S-4 | 1.0 | S-4 | 0.050 | 30.7 |
| DA-2 | S-3 | 1.0 | S-3 | 0.050 | 35.6 |
| DA-3 | S-3 | 1.0 | S-3 | 0.010 | 38.4 |
| DA-4 | S-5 | 1.0 | S-5 | 0.050 | 32.1 |
| DB-1 | S-2 | 1.0 | S-2 | 0.050 | 49.0 |
| DB-2 | S-1 | 1.0 | S-1 | 0.050 | — |
| DB-3 | S-3 | 1.0 | S-3 | 0.008 | 47.3 |
| DB-4 | S-3 | 1.0 | S-3 | 0.120 | 31.0 |
| DB-5 | S-6 | 1.0 | S-6 | 0.050 | 36.5 |
| DB-6 | S-7 | 1.0 | S-7 | 0.050 | 35.8 |

In Table 1, a column "Amount" under "External additive (resin particles)" indicates amounts (unit: part by mass) relative to 100 parts by mass of mother particles.

TABLE 2

| | Resin raw material | | | | | |
|---|---|---|---|---|---|---|
| | Monomer | | Cross-linking agent | Emulsifier | Particle | Blocking |
| Resin particles | BMA [g] | S [g] | DVB [g] | DBS [g] | diameter [nm] | rate [% by mass] |
| S-1 | 100 | 95 | 5 | 6 | 60 | 70 |
| S-2 | 85 | 85 | 30 | 6 | 60 | 35 |
| S-3 | 80 | 80 | 40 | 6 | 60 | 26 |
| S-4 | 60 | 60 | 80 | 6 | 60 | 14 |
| S-5 | 80 | 80 | 40 | 4 | 100 | 24 |
| S-6 | 60 | 60 | 80 | 9 | 30 | 26 |
| S-7 | 60 | 60 | 80 | 3 | 120 | 28 |

In Table 2, items indicated under Resin raw material represent as follows.

(Monomer)

BMA: n-butyl methacrylate

S: styrene (Cross-Linking Agent)

DVB: divinylbenzene (Emulsifier)

DBS: sodium dodecylbenzenesulfonate

The following describes production methods, evaluation methods, and evaluation results for the developers DA-1 to DA-4 and DB-1 to DB-6 in the stated order. In evaluations in which errors might occur, an evaluation value was calculated by obtaining an appropriate number of measured values and calculating an arithmetic mean of the measured values in order to ensure that any errors were sufficiently small.

[Preparation of Materials]

(Preparation of Resin Particles S-1 to S-7)

With respect to each type of the resin particles S-1 to S-7, 600 g of ion exchanged water, the emulsifier (DBS: sodium dodecylbenzenesulfonate) in an amount shown in Table 2, 15 g of an initiator (BPO: benzoyl peroxide), and a resin raw material in amount and type as shown in Table 2 were added into a 1-L four-necked flask equipped with a stirrer, a cooling pipe, a thermometer, and a nitrogen inlet tube. In preparation of for example the resin particles S-1, 100 g of n-butyl methacrylate (BMA), 95 g of styrene (S), and 5 g of divinylbenzene (DVB) were added as resin raw materials together with 6 g of the emulsifier (DBS). In preparation of for example the resin particles S-5, 80 g of n-butyl methacrylate (BMA), 80 g of styrene (S), and 40 g of divinylbenzene (DVB) were added as resin raw materials together with 4 g of the emulsifier (DBS). Note that the purity (mass fraction) of divinylbenzene (DVB) used as the cross-linking agent was 80% in preparation of each type of the resin particles S-1 to S-7.

Subsequently, the internal atmosphere of the flask was changed to a nitrogen atmosphere by introducing nitrogen gas into the flask while the flask contents were stirred. Furthermore, the temperature of the flask contents was increased to 90° C. in the nitrogen atmosphere while the flask contents were stirred so that the flask contents were caused to react (specifically, polymerization reaction) for 3 hours at a temperature of 90° C. in the nitrogen atmosphere. As a result, an emulsion including a reaction product was yielded. Subsequently, the yielded emulsion was cooled and then dehydrated to give each type of resin particles S-1 to S-7 (powders). The resin particles S-1 to S-7 were each substantially constituted by a cross-linked styrene-acrylic acid-based resin. The respective types of the resin particles S-1 to S-7 had a number average primary particle diameter as shown under "Particle diameter" in Table 2. Each type of the resin particles S-1 to S-7 had a sharp particle size distribution, and included substantially only resin particles having a particle diameter (equivalent circle diameter) within plus or minus 5 nm of the number average particle diameter. The number average primary particle diameters of the respective types of resin particles were measured using a scanning electron microscope (SEM).

Figure 2:
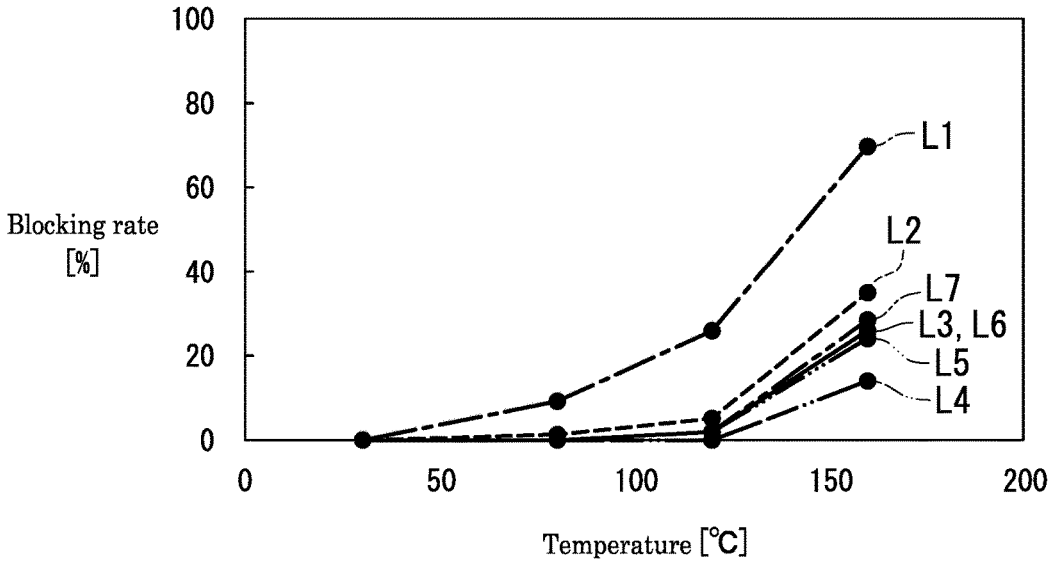
FIG. 2 is a graph representation indicating blocking rates of respective types of resin particles used in two-component developers according to Examples of the present invention.

Measurement results of a blocking rate (blocking rate measured using a mesh having a sieve opening of 75 μm after 5-minute pressure application at a temperature of 160° C. and a pressure of 0.1 kgf/mm$^2$) for the respective types of the resin particles (external additive) S-1 to S-7 prepared as above were as shown in Table 2. For example, the blocking rate of the resin particles S-1 was 70% (measurement temperature: 160° C.). In addition, blocking rates were also measured for each type of the resin particles at respective temperatures lower than 160° C. (30° C., 80° C., and 120° C.). The results are shown in FIG. 2. In FIG. 2, lines L1 to L7 represent blocking rates (measurement temperatures: 30° C., 80° C., 120° C., and 160° C.) of the respective types of resin particles S-1 to S-7. The lines L3 and L6 overlap with each other. That is, the resin particles S-3 and the resin particles S-6 had the same temperature characteristics in the blocking rate as each other. The blocking rates were measured as follows.

<Method for Measuring Blocking Rate of Resin Particles>

A device (product of KYOCERA Document Solutions Inc.) including a table (material: SUS304) having a cylindrical hole (diameter: 10 mm, depth: 10 mm), a columnar indenter (diameter 10 mm, material: SUS304), and a heater was used as a measurement jig. Note that SUS304 is an iron-chromium-nickel alloy (austenite stainless steel) having a nickel content of 8% by mass and a chromium content of 18% by mass.

In an environment of a temperature of 23° C. and a relative humidity of 50%, 10 mg of a measurement target (resin particles) was put into the hole (measurement site) of the jig. The measurement site was heated to a specific temperature (30° C., 80° C., 120° C., or 160° C.) by the heater of the jig, and a pressure of 0.1 kgf/mm$^2$ was applied to the measurement site (eventually, the resin particles in the measurement site) for 5 minutes using the indenter (load: approximately 100 N) of the jig. Thereafter, the resin particles in the measurement site (in the hole) were all collected and placed on a mesh (a 200-mesh sieve defined in JISZ8801-1 and having a line diameter of 50 μm and square openings in plain weave) having a known mass and a sieve opening of 75 μm. The mass of the sieve including the resin particles was measured to calculate a mass of the resin particles on the sieve (mass of resin particles before suction).

Subsequently, the resin particles on the sieve were sucked from below the sieve using an aspirator ("V-3SDR", product of AMANO Corporation). Through the suction, only resin particles that were not compressed into blocks among the resin particles on the sieve passed through the sieve. After the suction, a mass of resin particles that did not pass through the sieve (resin particles remaining on the sieve) was measured. A blocking rate (unit: % by mass) was calculated in accordance with the following expression based on the mass of the resin particles before suction and the mass of the resin particles after suction (mass of the resin particles that did not pass through the sieve).

$$\text{Blocking rate}=100\times(\text{mass of resin particles after suction})/(\text{mass of resin particles before suction})$$

Note that results of measurement before external additive addition are shown as examples. However, the same results as those of the measurement (blocking rates) shown in Table 2 were obtained even by calculating a blocking rate of resin particles (external additive) after separation of the resin particles from mother particles subjected to external additive addition thereof. The external additive can be separated from the mother particles using a ultrasonic disperser ("Ultrasonic Mini Welder P128", product of Ultrasonic Engineering Co., Ltd., output: 100 W, oscillation frequency: 28 kHz). The external additive separated from the mother particles can be collected by suction filtration. In a situation in which the collected external additive includes inorganic particles in addition to the resin particles, they can be separated using a centrifuge. Specifically, when centrifugation is performed on a dispersion of external additives including the resin particles and the inorganic particles, only the inorganic particles, which are heavier (having larger density) than the resin particles, sediment and a supernatant including the resin particles is obtained. The resin particles can be collected from the supernatant by pressure filtration.

[Production of Toner]

(Preparation of Toner Mother Particles)

Non-capsule toner particles (production method: pulverization, binder resin: polyester resin, releasing agent: ester wax ("NISSAN ELECTOL (registered Japanese trademark) WEP-3", product of NOF Corporation), colorant: carbon black ("MA100", product of Mitsubishi Chemical Corporation), charge control agent: quaternary ammonium salt ("BONTRON (registered Japanese trademark) P-51", product of ORIENT CHEMICAL INDUSTRIES, Co., Ltd.), volume median diameter ($D_{50}$): 7.0 μm) were prepared as toner mother particles.

(External Additive Addition to Toner)

A 10-L FM mixer (product of Nippon Coke & Engineering Co., Ltd.) was used to mix 100 parts by mass of the toner mother particles prepared as above, 1.5 parts by mass of positively chargeable silica particles ("AEROSIL (registered Japanese trademark) REA90", product of Nippon Aerosil Co., Ltd., content: dry silica particles made to have positive chargeability through surface treatment, number average primary particle diameter: approximately 20 nm), 1.5 parts by mass of conductive titanium oxide particles ("EC-100", product of Titan Kogyo, Ltd., base: $TiO_2$ particles, coat layer: Sb-doped $SnO_2$, number average primary particle diameter: approximately 0.35 μm), and 1.0 part by mass of an external additive shown under "First resin particles" in Table 1 (one type of the resin particles S-1 to S-7 specified for the respective developers) for 10 minutes. In one example, the resin particles S-4 were used as an external additive in addition to the silica particles and the titanium oxide particles in production of a toner for the developer DA-1. In another example, the resin particles S-3 were used as an external additive in addition to the silica particles and the titanium oxide particles in production of a toner for the developer DA-2. Next, sifting was performed using a 200-mesh sieve (sieve opening 75 μm). Through the above, a toner including a number of toner particles was produced.

[Production of Carrier]

(Preparation of Carrier Mother Particles)

Coated carrier particles (carrier cores: ferrite cores, coat layers: polyimide resin (PI) and tetrafluoroethylene-hexafluoropropylene copolymer (FEP), mass ratio of PI/FEP: 3/7, mass ratio of coat layers/carrier cores: 3/100, coverage ratio of coat layers: 100% (full coating), volume median diameter ($D_{50}$): 35 μm) were prepared as carrier mother particles.

(External Additive Addition to Carrier)

An FM mixer ("FM-10C", product of Nippon Coke & Engineering Co., Ltd., upper impellor: ST impellor, lower impellor: A0 impellor) was used to mix 100 parts by mass (specifically, 3 kg) of the carrier mother particles prepared as above and an external additive (one type of the resin particles S-1 to S-7 specified for the respective developers) of type and amount shown under "Second resin particles" in Table 1 for 5 minutes at a rotational speed of 3,500 rpm. In one example, 0.050 parts by mass of the resin particles S-4 were used as an external additive in production of a carrier for the developer DA-1. In another example, 0.050 parts by mass of the resin particles S-3 were used as an external additive in production of a carrier for the developer DA-2. Thereafter, sifting was performed using a 200-mesh sieve (opening 75 μm). Through the above, a carrier including a number of carrier particles was produced.

Carrier fluidity was measured for each carrier produced as above, results of which are as shown in Table 1. The carrier fluidity was measured as follows. For example, the carrier for the developer DA-1 had a carrier fluidity of 30.7 seconds. Note that the carrier fluidity of the carrier for the developer DB-2 was too low to be measured.

<Carrier Fluidity>

The carrier fluidity was measured in accordance with "Japanese Industrial Standard (JIS) Z2502". Specifically, a metal-made funnel (cone angle: 60°, orifice diameter: 2.5 mm, orifice length: 3.2 mm) was prepared and 50 g of a sample (carrier) was put into the funnel with the orifice of the funnel being blocked. Subsequently, a stopwatch was operated (measurement start) at the same time when the orifice of the funnel was opened, and the stopwatch was stopped (measurement end) at a moment when the last carrier (powder) separates from the orifice. A time period (passage time) measured by the stopwatch corresponds to a carrier fluidity.

[Preparation of Two-Component Developer]

A ball mill was used to mix 10 parts by mass of the toner prepared according to the above-described processes (one of the toners specified for the respective developers as shown in Table 1) and 100 parts by mass of the carrier prepared according to the above-described processes (one of the carriers specified for the respective developers as shown in Table 1) for 30 minutes to obtain each of the developers DA-1 to DA-4 and DB-1 to DB-6 (two-component developers).

[Evaluation Method]

Samples (developers DA-1 to DA-4 and DB-1 to DB-6) were each evaluated as follows.

(Fogging Durability)

A multifunction peripheral ("TASKalfa5550ci", product of KYOCERA Document Solutions Inc.) was used as an evaluation apparatus. A sample (evaluation target: one of the developers DA-1 to DA-4 and DB-1 to DB-6) was loaded into a development device of the evaluation apparatus, and a toner (toner for replenishment use) corresponding to the sample (developer) was loaded into a toner container of the evaluation apparatus.

Continuous printing at a coverage rate of 5% was performed on 100,000 sheets of paper (A4-size plain paper) using the evaluation apparatus in an environment at a temperature of 23° C. and a relative humidity of 50% as a printing durability test. During the printing durability test, fogging density (FD) of each of 100 printed sheets was measured. A maximum value among 100 measurement values was determined to be an evaluation value (fogging density) of the sample (toner). The fogging density (FD) was measured using a reflectance densitometer ("SpectroEye (registered Japanese trademark), product of X-Rite Inc.). A fogging density (FD) of no greater than 0.005 was evaluated as G (good). A fogging density (FD) of greater than 0.005 and no greater than 0.010 was evaluated as M (mediocre). A fogging density (FD) of greater than 0.010 was evaluated as P (poor). Note that the fogging density (FD) corresponds to a value obtained by subtracting a reflection density of base paper (non-printed paper) from a reflection density of a blank portion of the evaluation paper after printing.

(Carrier Contamination)

After the 100,000-sheet printing durability test in the fogging durability evaluation, the developer was taken out from the development device of the evaluation apparatus and fluorescent X-ray analysis was performed on a carrier in the taken-out developer under the conditions described below to plot a fluorescent X-ray spectrum (horizontal axis: energy, vertical axis: intensity (number of photons). An intensity of silica (Si) derived from the silica particles that were an external additive of a toner among silica (Si) present on a surface of the carrier (also referred to below as "contaminant Si intensity") was obtained based on the plotted fluorescent X-ray spectrum of the carrier. Note that the contaminant Si intensity corresponds to a value obtained by subtracting an intensity of silica (Si) present on a surface of a carrier (initial carrier) before preparation of a two-component developer from an intensity of silica (Si) present on a surface of a measurement target (carrier after the printing durability test).

<Fluorescent X-Ray Analysis>

Approximately 50 mg of a measurement target (carrier) was uniformly attached to an adhesive side of an adhesive tape ("DUNPLON (registered Japanese trademark) Tape"), and the adhesive tape was set on a measurement sample table (diameter 30 mm) of a scanning fluorescent X-ray analyzer ("ZSX 100e", product of Rigaku Corporation). Then, fluorescent X-ray analysis targeting F, Si, Fe, Zn, Ti, and Sn (six elements) as measurement target elements was performed using the scanning fluorescent X-ray analyzer.

A contaminant Si intensity of less than 10.0 kcps was evaluated as G (good). A contaminant Si intensity of at least 10.0 kcps and no greater than 15.0 kcps was evaluated as M (mediocre). A contaminant Si intensity of greater than 15.0 kcps was evaluated as P (poor).

[Evaluation Results]

With respect to each of the developers DA-1 to DA-4 and DB-1 to DB-6, evaluation results of fogging durability (fogging density) and carrier contamination (contaminant Si intensity) are shown in Table 3. As to "Overall evaluation" in Table 3, evaluation was marked as G (good) when both fogging durability and carrier contamination were evaluated as G (good), and was marked as P (poor) when either of them was not evaluated as G (good).

TABLE 3

| | Developer | Fogging durability | Carrier contamination [kcps] | Overall evaluation |
|---|---|---|---|---|
| Example 1 | DA-1 | 0.002 | 4.8 | G |
| Example 2 | DA-2 | 0.004 | 5.1 | G |
| Example 3 | DA-3 | 0.004 | 6.8 | G |
| Example 4 | DA-4 | 0.004 | 7.3 | G |
| Comparative Example 1 | DB-1 | 0.013 (P) | 20.2 (P) | P |
| Comparative Example 2 | DB-2 | 0.031 (P) | 25.4 (P) | P |
| Comparative Example 3 | DB-3 | 0.007 (M) | 12.2 (M) | P |
| Comparative Example 4 | DB-4 | 0.021 (P) | 22.6 (P) | P |
| Comparative Example 5 | DB-5 | 0.012 (P) | 14.4 (M) | P |
| Comparative Example 6 | DB-6 | 0.018 (P) | 21.5 (P) | P |

The developers DA-1 to DA-4 (two-component developers according to Examples 1 to 4) had the basic features. Specifically, in each of the developers DA-1 to DA-4, the toner included a plurality of toner particles each including a toner mother particle and a plurality of first resin particles attached to a surface of the toner mother particle. Furthermore, the carrier included a plurality of carrier particles each including a carrier mother particle and a plurality of second resin particles attached to a surface of the carrier mother particle. The amount of the second resin particles was at least 0.010 parts by mass and no greater than 0.100 parts by mass relative to 100 parts by mass of the carrier mother particles (see Table 1). The blocking rate of the first resin particles in each of the developers DA-1 to DA-4 measured using a mesh having a sieve opening of 75 μm after 5-minute pressure application at a temperature of 160° C. and a pressure of 0.1 kgf/mm$^2$ was less than 30% by mass (see Tables 1 and 2). The blocking rate of the second resin particles in each of the developers DA-1 to DA-4 measured using a mesh having a sieve opening of 75 μm after 5-minute pressure application at a temperature of 160° C. and a pressure of 0.1 kgf/mm$^2$ was less than 30% by mass (see Tables 1 and 2). A difference in blocking rate between the first resin particles and the second resin particles was no greater than 5% by mass (specifically, 0% by mass) in terms of an absolute value (see Tables 1 and 2). The first resin particles had a number average primary particle diameter of at least 40 nm and no greater than 100 nm (see Tables 1 and 2). The second resin particles had a number average primary particle diameter of at least 40 nm and no greater than 100 nm (see Tables 1 and 2). A difference in number average primary particle diameter between the first resin particles and the second resin particles was no greater than 5 nm (specifically 0 nm) in terms of an absolute value (see Tables 1 and 2). The first resin particles and the second resin particles contained resins of the same species (specifically, polymers of n-butyl methacrylate, styrene, and divinylbenzene) as each other (see Tables 1 and 2).

Note that in each of the developers DA-1 to DA-4, at least one type of inorganic particles (specifically, silica particles and titanium oxide particles) were attached in addition to the first resin particles to surfaces of the toner mother particles while no inorganic particles were externally added to surfaces of the carrier mother particles (see "External Additive Addition to Toner" and "External Additive Addition to Carrier"). The amount of the first resin particles was 1.0 part by mass relative to 100 parts by mass of the toner mother particles. The total amount of the at least one inorganic particles (silica particles and titanium oxide particles) was 3.0 parts by mass (=(1.5 parts by mass)+(1.5 parts by mass)) relative to 100 parts by mass of the toner mother particles (see "External Additive Addition to Toner").

As shown in Table 3, when any of the developers DA-1 to DA-4 was used, high-quality images could be continuously formed in continuous printing while fogging could be inhibited.

INDUSTRIAL APPLICABILITY

The two-component developer according to the present invention can be used for image formation for example using a copier, a printer, or a multifunction peripheral.

The invention claimed is:

1. A two-component developer comprising a toner and a magnetic carrier, wherein the toner includes a plurality of toner particles each including a toner mother particle and a plurality of first resin particles attached to a surface of the toner mother particle, the magnetic carrier includes a plurality of magnetic carrier particles each including a magnetic carrier mother particle and a plurality of second resin particles attached to a surface of the magnetic carrier mother particle, an amount of the second resin particles is at least 0.010 parts by mass and no greater than 0.100 parts by mass relative to 100 parts by mass of the magnetic carrier mother particles, a blocking rate measured for the first resin particles and a blocking rate measured for the second resin particles are each less than 30% by mass, each of the blocking rates being measured using a mesh having a sieve opening of 75 μm after 5-minute pressure application under conditions of a temperature of 160° C. and a pressure of 0.1 kgf/mm$^2$, a difference in blocking rate between the first resin particles and the second resin particles is no greater than 5% by mass in terms of an absolute value, respective number average primary particle diameters of the first resin particles and the second resin particles are at least 40 nm and no greater than 100 nm, a difference in number average primary particle diameter between the first resin particles and the second resin particles is no greater than 5 nm in terms of an absolute value, and the first resin particles and the second resin particles comprise the same resin.

2. The two-component developer according to claim 1, wherein the first resin particles and the second resin particles each comprise, as the resin, a polymer formed of monomers including a (meth)acrylic acid alkyl ester having an alkyl group having a carbon number of at least 1 and no greater than 4 at an ester moiety thereof, a styrene-based monomer, and a cross-linking agent having at least two unsaturated bonds.

3. The two-component developer according to claim 1, wherein the magnetic carrier mother particles each include a magnetic carrier core and a coat layer covering a surface of the magnetic carrier core.

4. The two-component developer according to claim 3, wherein the coat layer contains a fluororesin.

5. The two-component developer according to claim 1, wherein at least one type of inorganic particles are attached to the surface of the toner mother particle in addition to the first resin particles, and no inorganic particles are externally added to the surface of the magnetic carrier mother particle.

6. The two-component developer according to claim 5, wherein an amount of the first resin particles is at least 0.5 parts by mass and no greater than 1.5 parts by mass relative to 100 parts by mass of the toner mother particles, and a total amount of the at least one type of inorganic particles is at least 1.0 part by mass and no greater than 4.5 parts by mass relative to 100 parts by mass of the toner mother particles.

* * * * *